US008334659B2

(12) United States Patent
Aurongzeb et al.

(10) Patent No.: US 8,334,659 B2
(45) Date of Patent: Dec. 18, 2012

(54) ELECTRONIC DRIVER DIMMING CONTROL USING RAMPED PULSED MODULATION FOR LARGE AREA SOLID-STATE OLEDS

(75) Inventors: Deeder Aurongzeb, Mayfield Heights, OH (US); Bruce Richard Roberts, Mentor-on-the-Lake, OH (US)

(73) Assignee: General Electric Company, Schenectady, NY (US)

( * ) Notice: Subject to any disclaimer, the term of this patent is extended or adjusted under 35 U.S.C. 154(b) by 338 days.

(21) Appl. No.: 12/634,911

(22) Filed: Dec. 10, 2009

(65) Prior Publication Data

US 2011/0140626 A1 Jun. 16, 2011

(51) Int. Cl.
*H05B 37/02* (2006.01)

(52) U.S. Cl. ..... 315/250; 315/225; 315/227 R; 315/241 R; 315/291; 315/307

(58) Field of Classification Search ..... 315/223, 315/224, 225, 227 R, 241 R, 250, 291, 307
See application file for complete search history.

(56) References Cited

U.S. PATENT DOCUMENTS

| | | | | |
|---|---|---|---|---|
| 4,325,021 | A * | 4/1982 | McMackin | 323/351 |
| 6,441,596 | B1 | 8/2002 | Inque | |
| 2002/0063534 | A1 * | 5/2002 | Min | 315/169.3 |
| 2006/0245174 | A1 * | 11/2006 | Ashdown et al. | 362/85 |
| 2007/0108846 | A1 | 5/2007 | Ashdown | |
| 2007/0236440 | A1 | 10/2007 | Wacyk et al. | |
| 2008/0074060 | A1 * | 3/2008 | Ye et al. | 315/307 |
| 2008/0122758 | A1 | 5/2008 | Kim | |
| 2009/0174262 | A1 * | 7/2009 | Martin et al. | 307/82 |
| 2009/0184662 | A1 * | 7/2009 | Given et al. | 315/294 |
| 2009/0184666 | A1 * | 7/2009 | Myers et al. | 315/297 |
| 2009/0195191 | A1 * | 8/2009 | Lin et al. | 315/307 |
| 2009/0289559 | A1 * | 11/2009 | Tanaka et al. | 315/185 R |
| 2010/0138069 | A1 * | 6/2010 | Nerone et al. | 700/296 |
| 2010/0301751 | A1 * | 12/2010 | Chobot et al. | 315/86 |
| 2010/0320978 | A1 * | 12/2010 | Hunt et al. | 323/282 |

FOREIGN PATENT DOCUMENTS

| | | |
|---|---|---|
| EP | 1 973 385 | 9/2008 |
| GB | 2318467 A | 4/1998 |
| WO | 2006013035 A2 | 2/2006 |
| WO | WO 2006/039789 | 4/2006 |
| WO | WO 2007/120475 | 10/2007 |

OTHER PUBLICATIONS

WO Search Report issued in connection with corresponding WO Patent Application No. US10/55971 filed on Nov. 9, 2010.

* cited by examiner

*Primary Examiner* — Douglas W Owens
*Assistant Examiner* — Thai Pham
(74) *Attorney, Agent, or Firm* — Fay Sharpe LLP

(57) ABSTRACT

An electronic driver apparatus and methods are disclosed for driving power an organic LED or other large area solid state light source, in which a switch mode DC current source provides DC current to drive the light source according to a control input and a controller provides a ramped pulse modulated control input to the current source for at least some values of a dimming setpoint signal or value to mitigate damaging current spikes by controlling di/dt of the drive current.

19 Claims, 5 Drawing Sheets

ELECTRONIC DRIVER DIMMING CONTROL USING RAMPED PULSED MODULATION FOR LARGE AREA SOLID-STATE OLEDS

BACKGROUND OF THE DISCLOSURE

Large area solid-state lighting devices, such as organic light-emitting diodes (OLEDS), are becoming more popular for illuminating buildings, roads, and in other area lighting applications, as well as in a variety of signage and optical display applications. Such applications require long service life without color shift or lumen degradation to be commercially viable. Thus, there remains a need for improved OLED driver apparatus and techniques to control consistent illumination with dimming capabilities while mitigating flicker and premature device degradation for extended usable device service lifetime.

SUMMARY OF THE DISCLOSURE

The present disclosure provides drivers and methods for powering OLEDs and other large area solid-state light sources in which a switch mode DC current source provides DC current to drive the light source according to a control input and a controller provides a ramped pulse modulated control input to the current source for all or a portion of a range of a dimming setpoint signal or value. The ramped modulation involves controlled transitions between drive current levels to limit high rates of change of the device current (di/dt) to avoid or mitigate premature lumen degradation and color shift.

A driver apparatus is provided, which includes a switch mode DC current source to provide current to power one or more large area solid-state light sources according to a control input, as well as a controller that provides the control input to the current source according to a setpoint signal or value. The controller provides the control input as a ramped pulse modulated waveform for at least some values of a setpoint signal or value. The modulated waveform includes transitions between two or more control input values with controlled increasing profiles having a rise time value of about 100 μs or more and about 2 ms or less between control input values, and also includes controlled decreasing profiles having a fall time value of about 100 μs or more and about 2 ms or less between control input values. In some embodiments, the rise time value and the fall time value are the same, such as about 1 ms in some implementations. In other embodiments, the rise time value and the fall time value are unequal. The increasing and/or decreasing profiles are linear in some embodiments. In certain embodiments, all or a portion of at least one of the increasing profile and the decreasing profile is nonlinear. The driver in some embodiments includes a feedback circuit that senses the light source current and provides a feedback signal to the controller, with the controller providing the pulse modulated control input to the current source at least partially according to the feedback signal. In certain embodiments, moreover, the controller provides the pulse modulated control input at a modulation frequency of about 100-2000 Hz.

A method is provided for powering at least one large area solid-state light source. The method includes controlling a switch mode DC current source to provide DC electrical current to power at least one large area solid-state light source according to a control input. The method further includes providing a pulse modulated control input to the current source as a pulse modulated a waveform for at least some values of a setpoint signal or value. The pulse modulated waveform includes transitions between control input values with controlled increasing profiles having a rise time value of about 100 μs or more and about 2 ms or less between control input values and with controlled decreasing profiles having a fall time value of about 100 μs or more and about 2 ms or less between control input values. In some embodiments, the rise time value and the fall time value are about 1 ms, and in certain embodiments the rise time value and the fall time value are unequal. One or both of the profiles may be linear, and all or a portion of the increasing and/or decreasing profiles can be nonlinear.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1A:
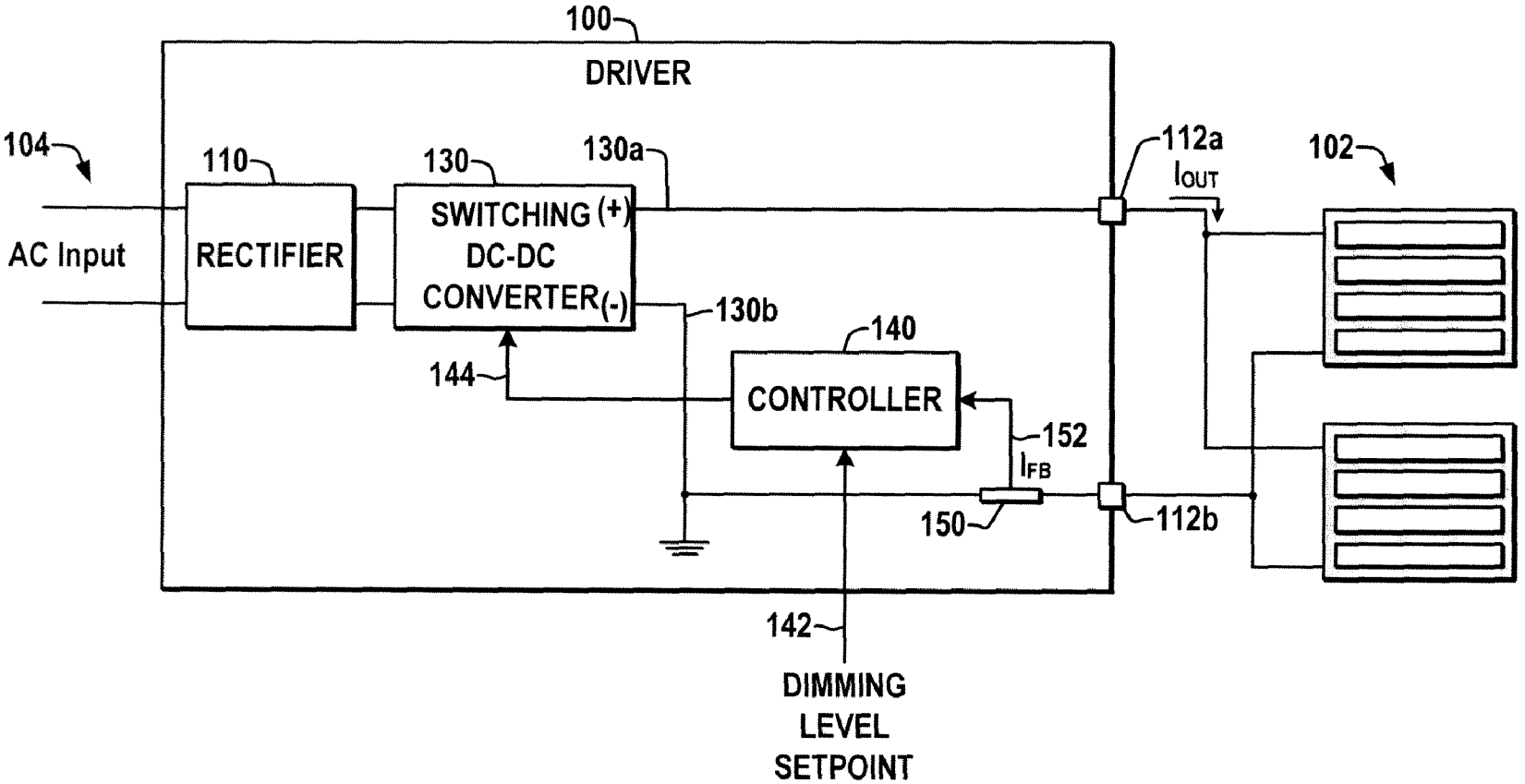
FIG. 1A is a schematic diagram illustrating a driver apparatus with a switch-mode DC current source and a controller providing ramped pulse modulation control for driving large area solid-state light sources.

Referring now to the drawings, where like reference numerals are used to refer to like elements throughout, and wherein the various features are not necessarily drawn to scale, the present disclosure relates to electronic drivers and methods for powering large area solid-state light sources which may be used in connection with various types and series/parallel configurations of such light sources. The disclosed concepts may be employed in association with organic LED (OLED) light sources or other solid-state lighting devices having large cross-sectional areas.

Figure 1B:
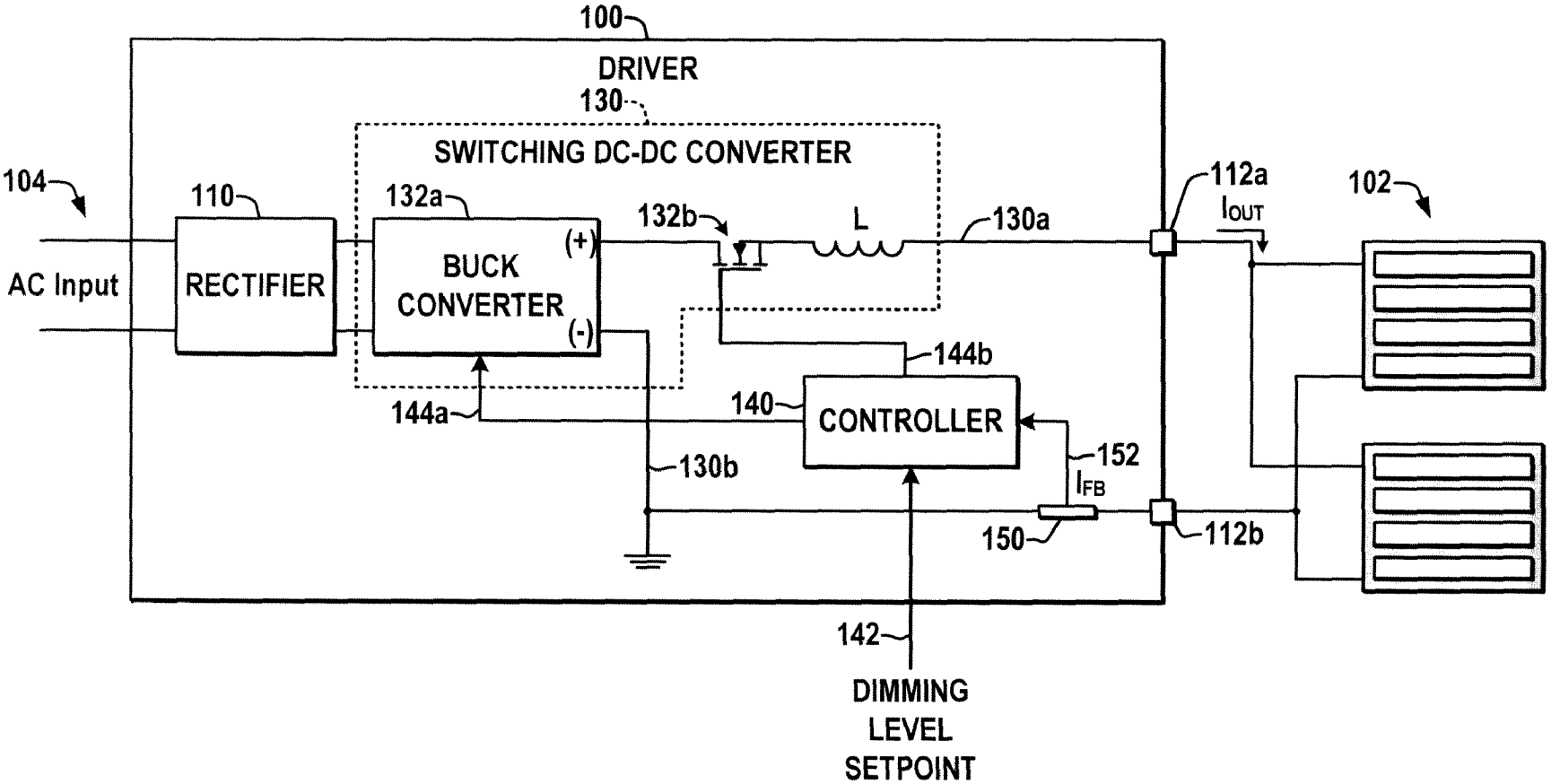
FIG. 1B is a schematic diagram illustrating another exemplary driver apparatus with a switch-mode DC current source including a buck converter and an output switch, as well as a controller providing ramped pulse modulation control for the switch to drive the large area solid-state light sources.
Figure 2:
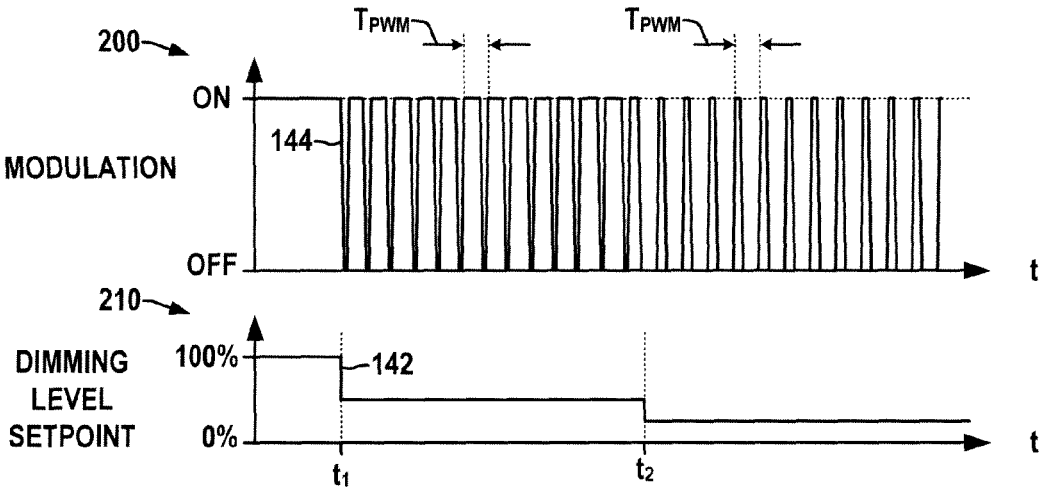
FIG. 2 is a graph showing corresponding dimming level setpoint values and selectively modulated control input for controlling the DC current source in the driver apparatus of FIGS. 1A and 1B.

Referring initially to FIGS. 1A, 1B and 2, an electronic driver apparatus 100 is illustrated in FIG. 1A for powering one or more large area solid-state light sources 102, in this case a parallel combination of two panels, each including four series-coupled 4 volt, 50 mA OLED panels for a lighting application. The driver 100 includes a switch mode DC current source 130 operative to provide DC electrical current to the light source 102 according to a control input 144 provided by a controller 140. The DC source 130 is a switch-mode DC-DC converter in one embodiment that receives input DC power from a rectifier 110, which converts input AC power from input terminals 104. The converter 130 provides DC electrical current for energizing one or more large solid-state light sources 102, such as OLED(s). Any suitable switch-mode DC power source 130 may be employed in the driver 100, which may be internally powered (e.g., via batteries, solar cells, etc.) or which may generate DC output power by conversion from an input supply (e.g., rectifier 110 converting input AC power received at the input 104). The source 130 provides DC output voltage at output terminals 130*a* (+) and 130*b* (−) and is operative to supply DC current to a load coupled across the terminals 130*a*, 130*b*, in this case including the OLED panels 102. The controller 140 can be an analog circuit or a processor-based circuit (e.g., including a microcontroller, microprocessor, logic circuit, etc.) or combinations thereof which provide one or more control inputs 144 to the DC source 130 based at least in part on the received setpoint 142. The driver 100 provides output terminals 112*a* and 112*b* for connection of one or more large area solid-state light sources 102, such as one or more OLEDs for lighting applications when electrical current is provided by the driver 100.

FIG. 1B illustrates another exemplary driver apparatus 100 in which the switch-mode DC current source 130 includes a buck converter 132*a* controlled by a first control input 144*a* from the controller 140. The DC-DC converter 130 in this embodiment also includes an output switch 132*b* operated by a second control input 144*b* from the controller 140 and a series choke L. The output switch 132*b* is operable in a first ('ON') state to allow electrical current to flow from the power source 130 to the light source(s) 102, and in a second ('OFF') state to prevent current from flowing from the power source 130 to the load 102. In one exemplary form of operation, the buck converter 132*a* operates according to a regulation loop around the input 144*a* while the switch 132*b* is operated according to the second control input 144*b*. In this case, the controller 140 selectively provides ramped pulse modulation control of the output switch 132*b* via the input 144*b* for the switch to drive the large area solid-state light sources during dimming operation.

One or more feedback signals 152 may be generated by feedback circuitry 150 in the driver apparatus of FIGS. 1A and 1B, which are provided to the controller 140 in certain embodiments. A shunt device 150 in the illustrated examples allows sensing of the load current flowing through the light source load 102, and provides a current feedback signal 152 ($I_{FB}$) to the controller 140. The controller 140 can use the feedback signal 152 to infer or compute one or more aspects of the performance of the light source 102 and/or of the power source 130 and make any necessary adjustments to the control input(s) 144.

FIG. 2 provides a graph 200 showing the control input 144 and a corresponding graph 210 showing corresponding exemplary dimming level setpoint values 142. In one example, the controller 140 implements selective pulse width modulation (PWM) control of the current source 130 for at least some values of a setpoint signal or value 142 for controlling the DC current source in the driver apparatus of FIG. 1A. In this exemplary form of operation, the controller 140 provides the control input 144 to the source 130 as a constant value for 100% output, and receives the dimming setpoint signal or value 142 from an external source (e.g., from a user-operated wall dimmer knob or slide control). When the dimming level setpoint 142 indicates less than 100% light output is desired, the controller 140 provides a pulse modulated control input 144 to the current source 130 according to the setpoint signal or value 142.

As the user changes the dimming setpoint 142 to less than 100% of rated power (e.g., at $t_1$ in graph 210), the controller 140 modulates the control input 144 at a modulation period $T_{PWM}$ to provide portions of each period $T_{PWM}$ at a first level of current (e.g., 100% in one example with the converter 132*a* providing 100% of the rated current and with the switch 132*b* "ON" or closed), and the remaining portions at a second level of output current $I_{OUT}$ (e.g., switch 132*b* "OFF"). In this manner, the OLED light sources 102 are driven at less than 100% rated current and the light output is dimmed. At $t_2$ in FIG. 2, the user-selected dimming level 142 is further decreased, and the controller 140 adjusts the pulse with modulation by decreasing the on-time within each PWM period $T_{PWM}$, and the controller 140 operates in similar fashion to provide any desired level of dimming according to the setpoint 142 by adjusting the pulse modulated control input 144 provided to the DC current source 130.

In some embodiments, the DC source 130 is controlled to provide 100% rated current without pulse modulation and modulated control inputs 144 are provided for some range of lower dimming levels, and in other embodiments pulse modulated signals 144 are used throughout the dimming range 0%-100%, wherein all such embodiments are contemplated that provide pulse modulated control inputs 144 to the source 130 for at least some values of a setpoint signal or value 142. In the example of FIG. 1A, the modulated control input 144 is provided as a setpoint for the source 130, which regulates its output to that level. In the example of FIG. 1B, the converter 132*a* is regulated to a single DC current level, and modulated control inputs 144*b* are provided to the output switch 132*b* to selectively coupled/decoupled the converter output to/from the OLED load 102. Any form of modulation techniques can be used, including without limitation pulse width modulation (PWM), frequency modulation (FM), time division multiplexing (TDM), etc. In certain embodiments, the controller 140 provides the pulse modulated control input 144 to the current source 130 at a modulation frequency of about 100 Hz or more and about 2 kHz or less for at least some values of the setpoint signal or value 142. In this regard, the modulation is preferable performed at a frequency above about 100 Hz to avoid or mitigate undesirable user-perceptible flicker in the light output provided by the OLED sources 102. Pulsed dimming, moreover, advantageously avoids color shift typically experienced with linear dimming techniques in which non-modulated DC current levels are adjusted to dim the light output. In addition, pulsed dimming of OLED devices 102 eliminates the problem of individual portions of the device turning off before others when linearly dimmed.

The controller 140, moreover, provides ramped pulse modulation (RPM) signals 144 to the DC source 130 for at least some values of a setpoint signal or value 142. In this regard, the inventors have appreciated that OLED type and other large area solid-state lighting devices 102 may be of substantial capacitance, and further that such devices 102 may be susceptible to excessive current surges during transitions between driven current levels in pulsed dimming situations. Absent the novel RPM driving techniques employed by the controller 140, fast changes to the drive current $I_{OUT}$ could lead to a high current spike (including current overshoot and undershoot conditions) due to the capacitive load 102. Such excessive current transitions (high di/dt at the output 112) may degrade the OLED 102 by dissociating the organic interface, leading to reduced operational lifetime, lumen degradation, color shift, and/or early device failure. Thus, while modulated dimming per se helps to combat color shift, the large capacitance causes a spike in the current for every on and off cycle of traditional pulsed dimming methods. This can damage the device 102 and lead to very poor lumen depreciation, color shifting, and ultimately to device failure. The RPM dimming provided by the controller 140 allows for 0 to 100% dimming capability while maintaining color uniformity over all light levels without premature device degradation. RPM allows the use of all pulsed modulation methods in large area OLED devices to gain these benefits without the damages normally caused by traditional pulsing methods.

Ramped Pulse Modulation (RPM) advantageously controls the dv/dt and the resulting di/dt for every switching cycle of the pulse modulation dimming, and may be used with any form of pulse modulation. In this regard, the controller 140 controls the ramp up and ramp down times ($t_{up}$, $t_{down}$ in FIGS. 3A-3H below) of each transition between levels (each switching event) independent of the method of modulation. In some embodiments, a trapezoid modulation shape is used with transition times in both directions being maintained at about 1 ms, but other forms of wave shapes, transition profiles, etc. may be used, in which the transition times are controlled to be within about 100 μs and 2 ms. In this manner, the controller 140 limits the di/dt experienced by the OLED devices 102 and thus controls the size of the current spike induced by attempting to change the voltage quickly. In this regard, conventional pulse modulation efforts were directed to instead minimizing the transition time in order to optimize efficiency in the DC source 130. The controller 140 of the present disclosure, on the other hand, actively enforces limitations on the rise and fall times of the drive current $I_{OUT}$ in order to mitigate the above mentioned problems of OLED degradation, color shift, perceptible flicker, etc. In practice, the controller 140 can achieve these goals by means of the control input 144 using any suitable wave shapes to limit dv/dt and the resultant di/dt, such as linear transitions, non-linear transitions, exponential or logarithmic curve transitions, s-curve transitions, etc. Moreover, digital implementations of the controller 140 can provide discrete steps in the control input 144 to transition from state to state, preferably having a large enough number of discrete levels of sufficient duration such that the end result was a close approximation of the slowly changing analog transition of states.

Referring also to FIGS. 3A-3H, the pulsed modulation control of the switch-mode DC current source 130 provides ramped pulse modulation implemented by the controller 140 over all or at least a portion of the range of the dimming level setpoint 142. In this regard, the controller 140 provides the control input 144 as a pulse modulated a waveform having transitions between at least two control input values with controlled increasing (rising) profiles having a rise time value $t_{up}$ of about 100 μs or more and about 2 ms or less between control input values and with controlled decreasing (falling) profiles having a fall time value $t_{down}$ of about 100 μs or more and about 2 ms or less between control input values. In some embodiments, the rise time value $t_{up}$ and the fall time value $t_{down}$ are the same, for example, with the rise time value $t_{up}$ and the fall time value $t_{down}$ being within about +/−2% of 1 ms. In other embodiments, the rise time value $t_{up}$ and the fall time value $t_{down}$ are unequal, where the rise time value $t_{up}$ in some cases can be longer than the fall time value $t_{down}$ and in other examples the rise time value $t_{up}$ is shorter than the fall time value $t_{down}$. In some embodiments, moreover, one or both of the increasing profile and the decreasing profile can be linear (e.g., substantially straight transition as a function of time), and in other embodiments, at least a portion of one or both of the increasing profile and the decreasing profile is nonlinear.

Figure 3A:
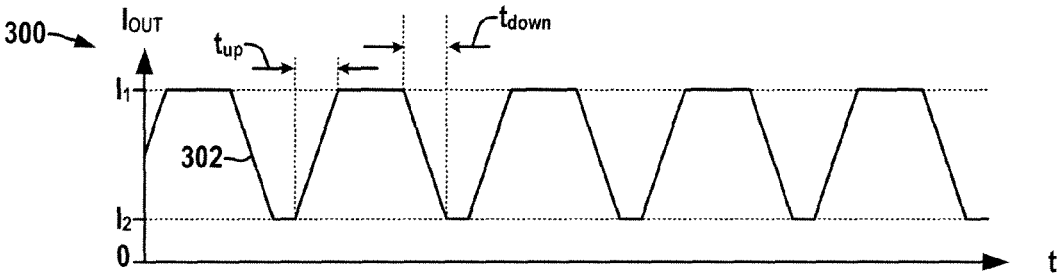
FIGS. 3A-3H are graphs illustrating exemplary ramped pulse modulated driver current in dimming operation of the driver apparatus of FIGS. 1A and 1B.
Figure 3B:
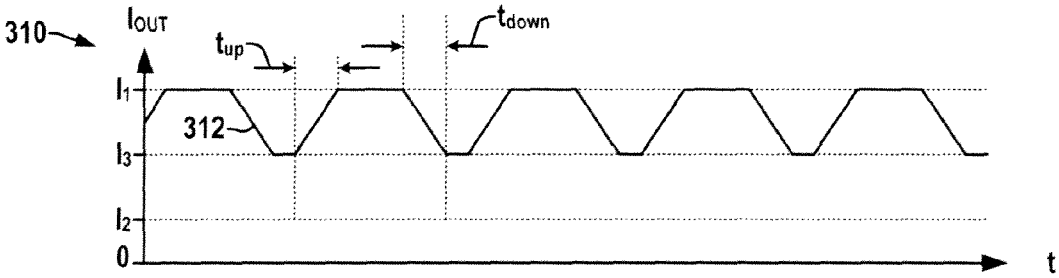
Figure 3C:
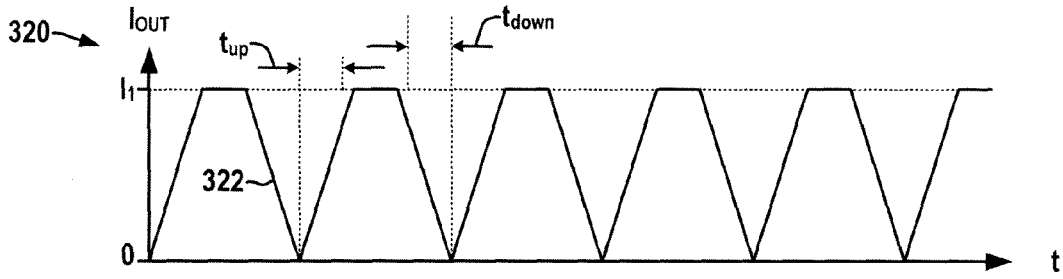

FIGS. 3A-3H provide several non-exhaustive examples of possible ramped pulse modulation in the drivers 100 above, in which the examples are shown for some non-100% value of the dimming level setpoint 142. FIGS. 3A-3C provide graphs 300, 310, and 320, respectively, showing a driver output current ($I_{OUT}$) curves 302, 312, and 322 as a function of time in which the controller 140 modulates either the buck converter control input or an output switch 132*b* to generate an output current that varies between a first current level $I_1$ and a second lower level $I_2$ with linear rising and falling transitions of generally equal durations $t_{up}$ and $t_{down}$ between about 100 μs and 2. The modulation techniques in these examples may provide for non-zero dwell times at one or both levels $I_1$ and $I_2$, although not a strict requirement, wherein one or both levels may involve zero dwell times (e.g., FIG. 3C) and wherein the dwell times may vary according to the value of the dimming setpoint 142. Moreover, the upper and lower current levels $I_1$ and $I_2$ may, but need not correspond to the 0% and 100% output levels of the source 130.

Figure 3D:
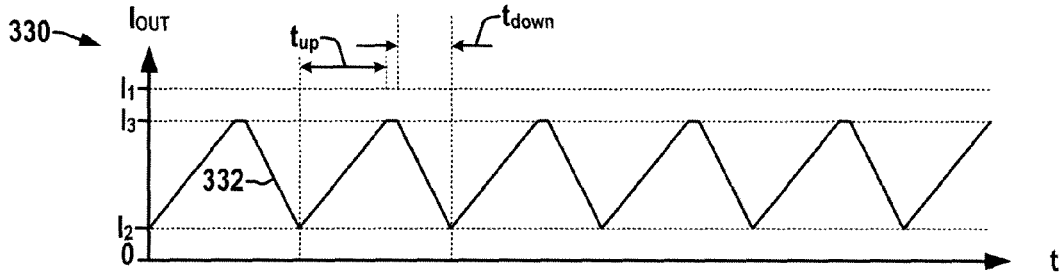
Figure 3E:
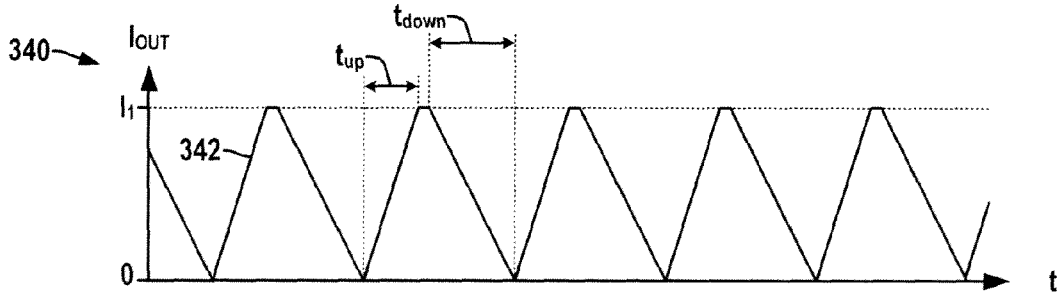
Figure 3F:
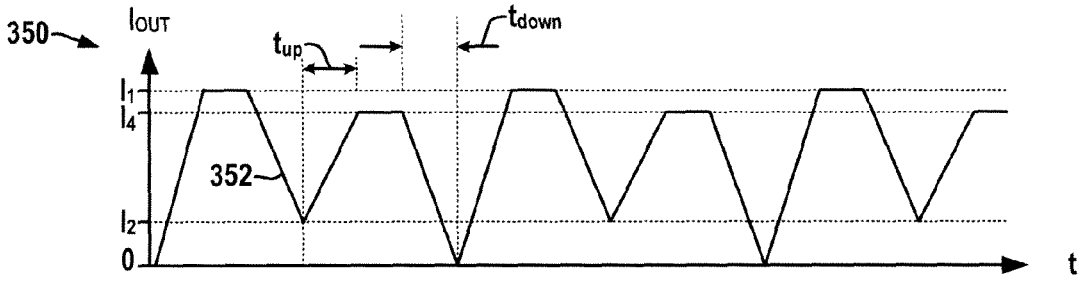

The graphs 330 and 340 in FIGS. 3D and 3E illustrate examples in which the waveform output curves 332 and 342 have unequal rising and falling durations $t_{up}$ and $t_{down}$. As shown in graph 350 of FIG. 3F, moreover, the curve ramped modulation waveform 352 may involve transitions to and from any number of different current levels $I_1$-$I_4$.

Figure 3G:
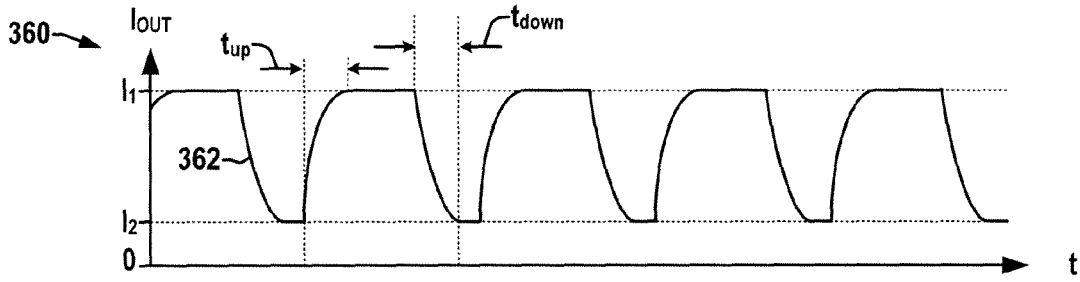
Figure 3H:
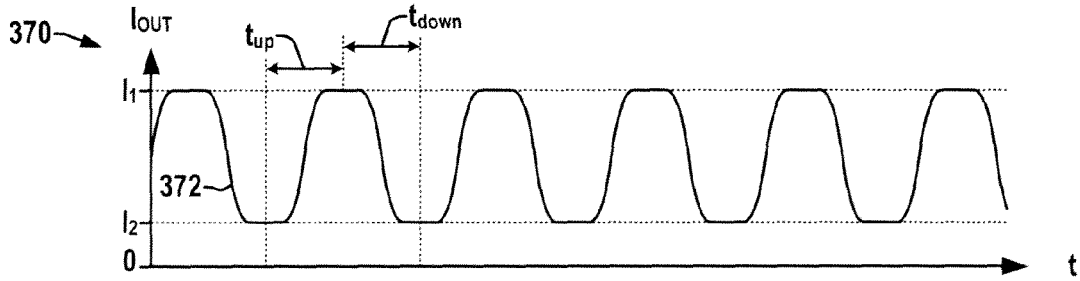

Other exemplary embodiments are shown in the graphs 360 and 370 of FIGS. 3G and 3H, in which exponential, logarithmic, and/or s-shaped transition profiles may be used, preferably having smooth (i.e., low di/dt) portions near the ends of the transitions to alleviate current overshoot and/or undershoot, wherein the transitions may, but need not, include linear portions, and wherein the transition times $t_{up}$ and $t_{down}$ may, but need not, be equal. The curve 362 in FIG. 3G, for example, provides rising and falling transitions having logarithmic profiles in which the rates of change decrease at the ends of the transitions. The curve 372 in FIG. 3H includes s-shaped rising and falling transition profiles where the illustrated modulation level/technique includes non-zero dwell times at the first and second current levels $I_1$ and $I_2$, where other examples (or other modulation levels of the same embodiment) need not have non-zero dwell times at one or both levels $I_1$ and $I_2$, such that the modulation may become wholly or partially sinusoidal.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The invention claimed is:

1. An electronic driver apparatus for powering one or more large area solid-state light sources, the driver apparatus comprising:

a DC current source operative to provide DC electrical current to power at least one large area solid-state light source according to a control input;

a controller receiving a continuous dimming level setpoint signal or value indicating a desired brightness level for the at least one large area organic solid-state light source, the controller being operative for at least some values of the dimming setpoint signal or value to provide a pulse modulated control input to the current source according to the dimming setpoint signal or value, the pulse modulated control input being provided by the controller as a pulse modulated waveform having periodic transitions between at least two control input values in each of a plurality of pulse width modulation periods, wherein the periodic transitions have controlled increasing profiles with a rise time value of about 100 μs or more and about 2 ms or less between the control input values and controlled decreasing profile with a fall time value of about 100 μs or more and about 2 ms or less between the control input values to mitigate large surge currents in the at least one large area organic solid-state light source, and wherein the continuous dimming level setpoint signal or value is substantially constant during a time period which includes multiple pulse width modulation periods.

2. The electronic driver apparatus of claim 1, wherein the rise time value and the fall time value are the same.

3. The electronic driver apparatus of claim 2, wherein the rise time value and the fall time value are about 1 ms.

4. The electronic driver apparatus of claim 3, wherein at least one of the increasing profile and the decreasing profile is linear.

5. The electronic driver apparatus of claim 1, further comprising a feedback circuit operative to sense the DC electrical current provided to the at least one large area organic solid-state light source and to provide a feedback signal to the controller indicative of the DC electrical current provided to the at least one large area organic solid-state light source, wherein the controller provide a pulse modulated control input to the current source at least partially according to the feedback signal for at least some values of the setpoint signal or value.

6. The electronic driver apparatus of claim 1, wherein the rise time value and the fall time value are unequal.

7. The electronic driver apparatus of claim 6, wherein the rise time value is longer than the fall time value.

8. The electronic driver apparatus of claim 6, wherein the rise time value is shorter than the fall time value.

9. The electronic driver apparatus of claim 1, wherein the controller provides the pulse modulated control input to the current source at a modulation frequency of about 100 Hz or more and about 2 kHz or less for at least some values of the setpoint signal or value.

10. The electronic driver apparatus of claim 1, wherein at least one of the increasing profile and the decreasing profile is linear.

11. The electronic driver apparatus of claim 1, wherein at least a portion of at least one of the increasing profile and the decreasing profile is nonlinear.

12. The electronic driver apparatus of claim 11, wherein at least a portion of both the increasing profile and the decreasing profile is nonlinear.

13. The electronic driver apparatus of claim 1, wherein the dimming setpoint signal or value indicates a desired brightness level of 0% or more and 100% or less for the at least one large area organic solid-state light source, and wherein the controller is operative to provide the pulse modulated control input to the current source as a pulse modulated waveform having periodic transitions between at least two control input values in each of a plurality of pulse width modulation periods for at least some values of the dimming setpoint signal or value greater than 0% and less than 100%.

14. A method of powering at least one large area solid-state light source, the method comprising:

controlling a DC current source to provide DC electrical current to power at least one large area solid-state light source according to a control input;

receiving a continuous dimming level setpoint signal or value indicating a desired brightness level for the at least one large area organic solid-state light source;

for at least some values of the dimming setpoint signal or value, providing a pulse modulated control input to the current source according to the dimming setpoint signal or value as a pulse modulated waveform having periodic transitions between at least two control input values in each of a plurality of pulse width modulation periods, wherein the periodic transitions have controlled increasing profiles with a rise time value of about 100 μs or more and about 2 ms or less between control input and controlled decreasing profiles with a fall time value of about 100 μs or 2 ms or less between control input values to mitigate large surge currents in the at least one large area organic solid-state light source, and wherein the continuous dimming level setpoint signal or value is substantially constant during a time period which includes multiple pulse width modulation periods.

15. The method of claim 14, wherein the rise time value and the fall time value are about 1 ms.

16. The method of claim 14, wherein the rise time value and the fall time value are unequal.

17. The method of claim 14, wherein at least one of the increasing profile and the decreasing profile is linear.

18. The method of claim 14, wherein at least a portion of at least one of the increasing profile and the decreasing profile is nonlinear.

19. The method of claim 14, wherein the dimming setpoint signal or value indicates a desired brightness level of 0% or more and 100% or less for the at least one large area organic solid-state light source, and wherein the pulse modulated control input is provided to the current source as a pulse modulated waveform having periodic transitions between at least two control input values in each of a plurality of pulse width modulation periods for at least some values of the dimming setpoint signal or value greater than 0% and less than 100%.

* * * * *